358-190 SR
PWE50 XR 4,321,593

United States Patent [19]
Ho et al.

[11] 4,321,593
[45] Mar. 23, 1982

[54] TELEVISION SET WITH SUPERVISORY FUNCTIONS OF ALARMING BURGLARY AND SAFE WATCHING DISTANCE

[76] Inventors: Chi C. Ho, 2nd Fl., No. 5-3, 23 La., Nan-King W. Rd., Taipei; Tai H. Yang, No. 51, Tai-Pin St., Si-Hu Jenn, Chiang-Hwa Hsien, both of Taiwan

[21] Appl. No.: 123,423

[22] Filed: Feb. 21, 1980

[51] Int. Cl.[3] ..... G08B 13/00; G08B 21/00
[52] U.S. Cl. ..... 340/541; 340/571; 340/751; 340/691
[58] Field of Search ..... 340/541, 571, 751, 540, 340/691, 573, 568, 561, 562, 552, 551, 565, 567; 315/384; 367/94, 93

[56] References Cited

U.S. PATENT DOCUMENTS

| | | | |
|---|---|---|---|
| 3,289,194 | 11/1966 | King | 340/571 |
| 3,445,835 | 5/1969 | Fudaley | 340/568 |
| 3,469,252 | 9/1969 | Bet | 340/715 |
| 3,929,335 | 12/1975 | Malick | 340/573 |
| 3,988,533 | 10/1976 | Mick et al. | 340/715 |
| 4,189,719 | 2/1980 | Massa et al. | 367/93 |

*Primary Examiner*—Glen R. Swann, III
*Attorney, Agent, or Firm*—Cushman, Darby & Cushman

[57] ABSTRACT

A television set suppresses its video display or responds in another preselected fashion when a viewer is too close to its screen, and is also capable of serving as a burglar alarm. A predetermined condition causes a detection device to generate a signal, which is processed and used to trigger either an alarm, video suppression circuitry or another preselected response. Provision is made for a delay in triggering to prevent undesired responses.

11 Claims, 6 Drawing Figures

TELEVISION SET WITH SUPERVISORY FUNCTIONS OF ALARMING BURGLARY AND SAFE WATCHING DISTANCE

DETAILED DESCRIPTION OF THE INVENTION

Figure 1:
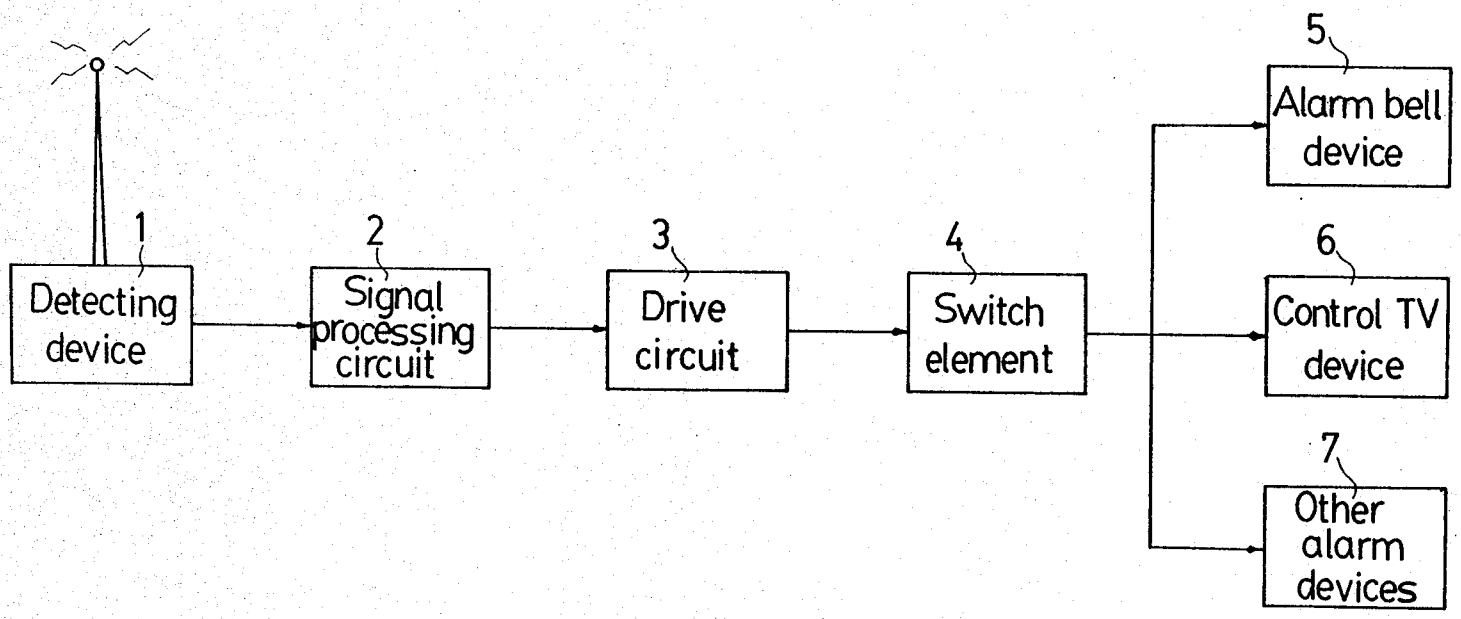
FIG. 1 is a flow chart of one embodiment of the present invention.

A television set with supervisory functions of alarming burglary and safe TV-watching distance consists mainly of the following two parts:

(1) The correlative circuits and devices of TV set per se.

(2) The supervisory device which comprises the following components and performs the following actions:

1. A set or more than one set of detecting devices (1) which can make use of supersonic, microwave and infrared detecting devices or similar detecting devices operating individually or collectively. The dimensions and distance of target to be detected can be adjusted if necessary.

2. a signal processing circuit (2) which can properly select, compare and amplify the detected signal and transmit said signal to the drive circuit (3) when coinciding with the established conditions so as to drive the switch element (4) to act. An adjustable delay timing circuit is set in the said signal processing circuit so as to establish the time required by the said TV set to generate the alarm signal and the established action in order to prevent the said TV set from generating action when a target temporarily enters into the control distance.

3. A device circuit (3) which is used for receiving the order signal from the signal processing circuit (2) so as to drive the switch element (4).

4. A switch element (4) which can be driven by the drive circuit (3) to open or close or perform other actions for changing output, to actuate the alarm bell device (5) for generating the established alarm sound, or to cut off or shorten the TV set image signal for displaying only scanning lines on the fluorescent screen, or to cut off the control TV device (6) or to actuate other methods and devices which can perform said alarm function so as to generate the desired effect of alarming burglary and maintaining safe TV-watching distance.

5. An alarm bell device and a control TV device (6) and other alarm devices (7) capable of performing some function which can individually or collectively receive signals from switch element (4) to generate the desired functions of alarming burglary and maintaining safe TV-watching distance.

One example of the supervisory device incorporating a supersonic wave detector is given as follows (FIG. 2):

Supervisory device: The transmitting unit transmits an oscillatory frequency of 40 KHz. The supersonic wave transmitted continuously by the transmitting transducer (11) will be reflected partially by any obstruction and caught by the receiving transducer (12). Since the transmitted energy is extremely weak, the receiving unit ought to have an amplifier with an extremely high gain.

Figure 2:
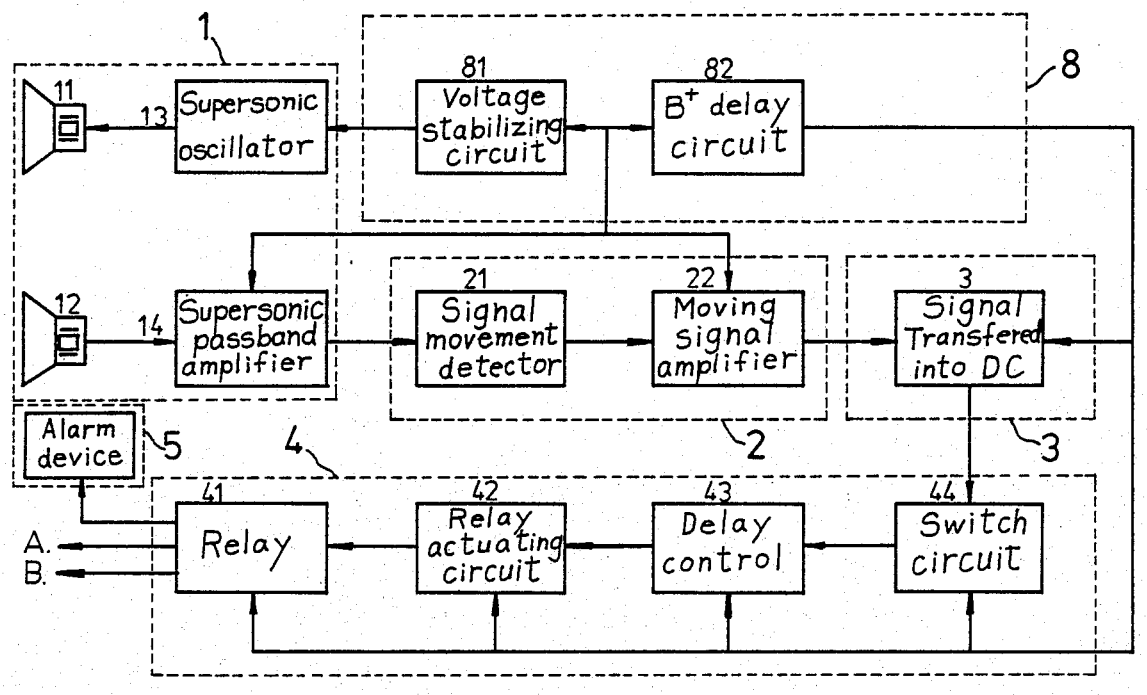
FIG. 2 is a block diagram of one example of a supersonic wave type supervisory device according to the present invention.
Figure 3:
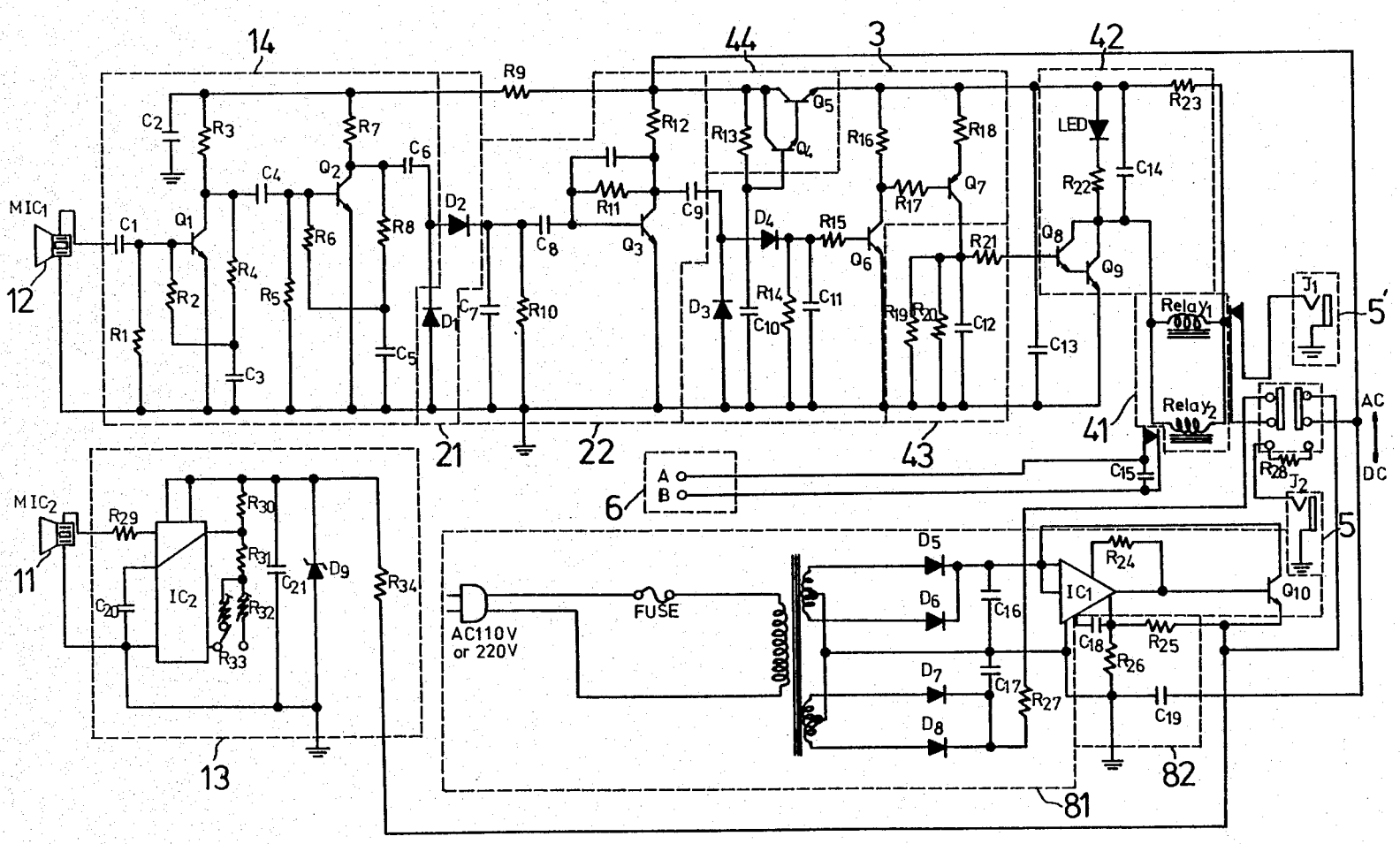
FIG. 3 is a schematic view of one embodiment of a supersonic wave type supervisory device according to the present invention.

As shown in FIG. 2 and FIG. 3 the power source supply device (8) provides the supersonic oscillator (13) with voltage through the voltage-stabilizing circuit (81) so that the transmitting unit steadily oscillates the supersonic voltage of a signal frequency. The output thereof with a frequency of about 40 KHz±1 KHz through the transmitting transducer (11) is transfered into the mechanical wave to be forwarded to the space in front, and the receiving transducer (12) receives the supersonic wave which is reflected in front and amplified by the supersonic passband amplifier wherein the two-stage amplification of the two transistor $Q_1$ and $Q_2$ is about 200–300 times. In order to avoid jamming by a foreign signal other than 40 KHz±1 KHz, a filter circuit is set between said two amplification stage transistors $Q_1$ and $Q_2$ which are thus transfered into a supersonic passband amplifier (14) so as to attenuate all the foreign signals other than 40 KHz±1 KHz.

Signal movement detector (21): $D_1$ and $D_2$ are detecting diodes. If somebody moves in front of the present invention, the $D_2$ will detect a low frequency (15 Hz–100 Hz) unstable AC signal. If nobody moves in front of the present invention, the $D_2$ will have no low frequency signal detection output.

Moving signal amplifier (22): $Q_3$ amplifies a weak signal detected by $D_2$ so as to enhance the signal voltage which becomes a DC voltage through the voltage doubler rectification by $D_3$ and $d_4$ and is charged by capacitor $C_{11}$.

Switch circuit (44): $Q_6$ and $Q_7$ are switch transistors. When the collector potential drops, the collector-emitter of $Q_7$ is closed, and $C_{12}$ charges instantaneously.

Figure 4:
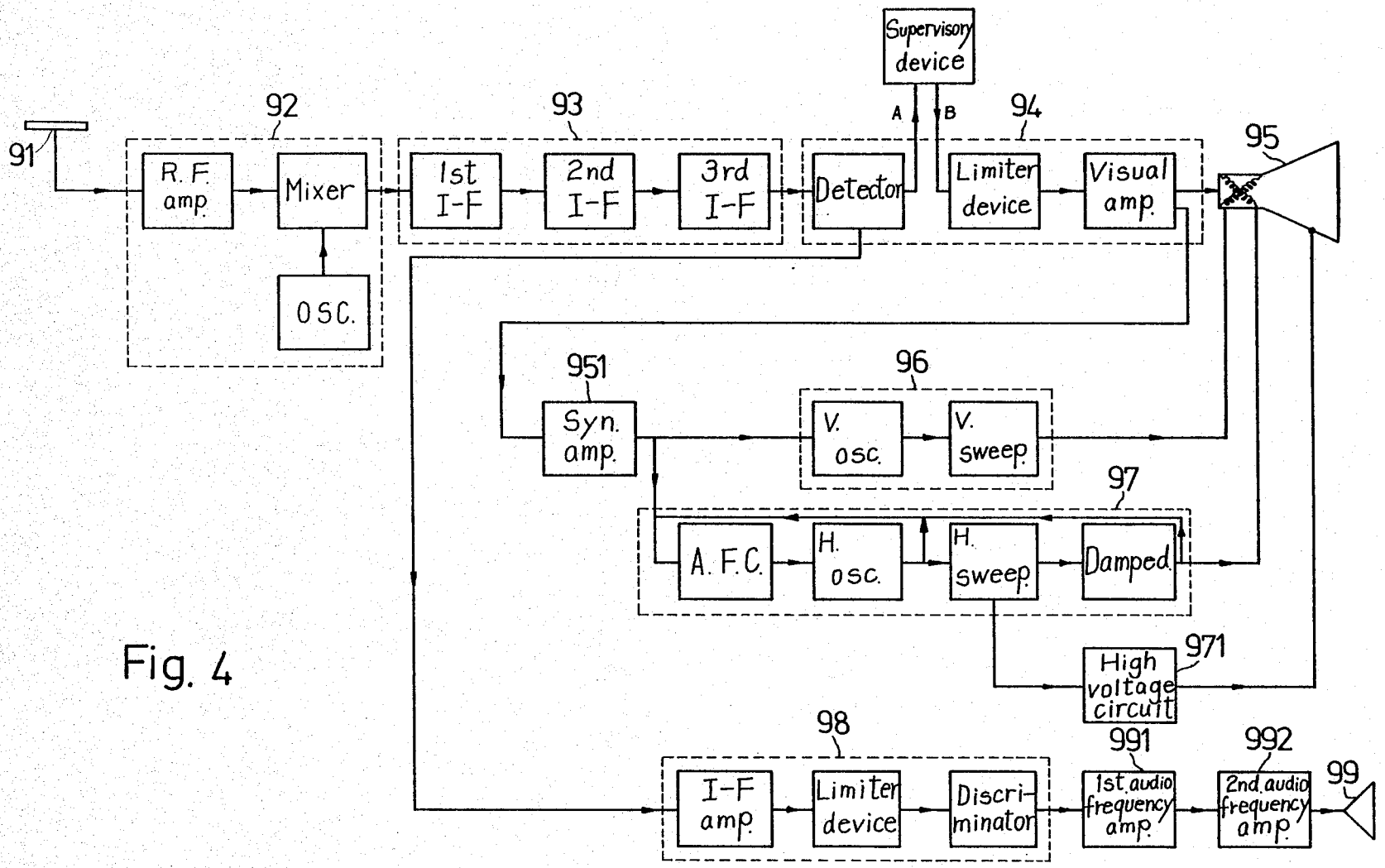
FIG. 4 is a block diagram of one embodiment of the present invention, designed to operate with a normally closed supervisory device.

Delay control (43): $C_{12}$, $R_{19}$, $R_{20}$ and $R_{21}$ from a delay circuit and can control the time length. The current discharge by $C_{12}$ through $R_{21}$ actuates the circuit (42) $Q_8$ and $Q_9$ through the coil of relay 41, and the collecting voltage of $Q_8$ and $Q_9$ drops so as to increase the voltage drop between the two ends of the relay and close the two sets of contacts connected to the relay (41), one set thereof being equipped with the alarm bell device and another set thereof being connected to points A and B of TV set for control of TV set ON-OFF as shown in FIG. 4. The said two contacts A and B may be either normally OPEN or normally CLOSE.

FIG. 4 is a TV set video frequency control incorporating a normally closed supervisory device. When nothing moves in front of the supervisory device, the weak signal cannot be received, the two contacts A and B close to form a closed circuit, and the current flows to contact B through contact A and further to the video frequency signal of next stage. If the supervisory device detects movement in front of it, the circuit opens, thus disconnecting the TV set video frequency signal. In this state the TV set has no video frequency signal output and image. One can also use this signal to activate the control TV device (6) to cut off the power source.

When one leaves beyond the control distance established for the TV set, the TV set once again resumes normal operation.

Figure 5:
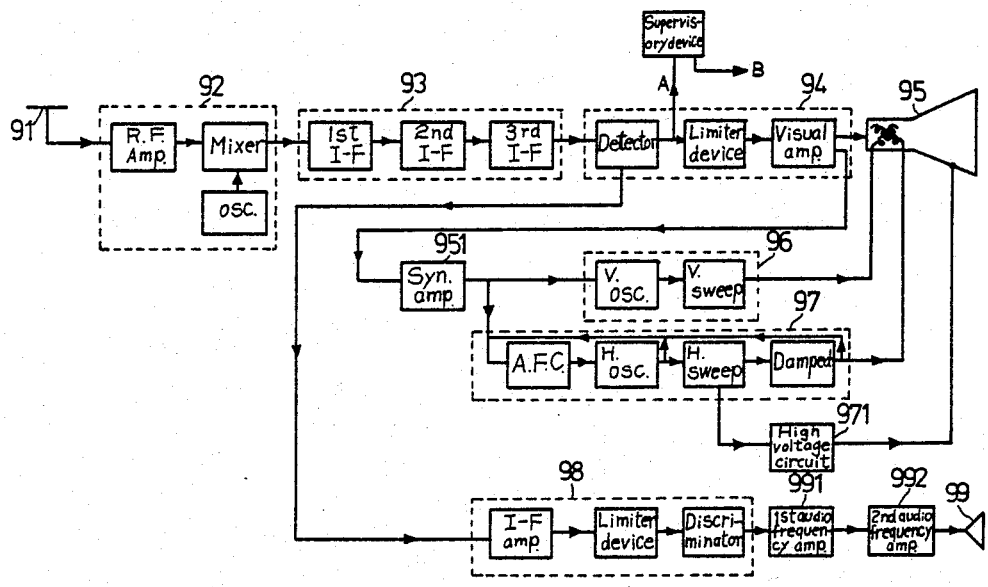
FIG. 5 is a block diagram of one embodiment of the present invention, designed to operate with a normally open supervisory device.

Another circuit is shown in FIG. 5 wherein the two contacts A and B are normally open. When the supervisory device receives the weak signal, the two contacts A and B short, but the contact B connects to the TV set ground so that the signal is shorted and a state of no output is produced. When somebody leaves, the two contacts A and B are open and restore normal state.

Figure 6:
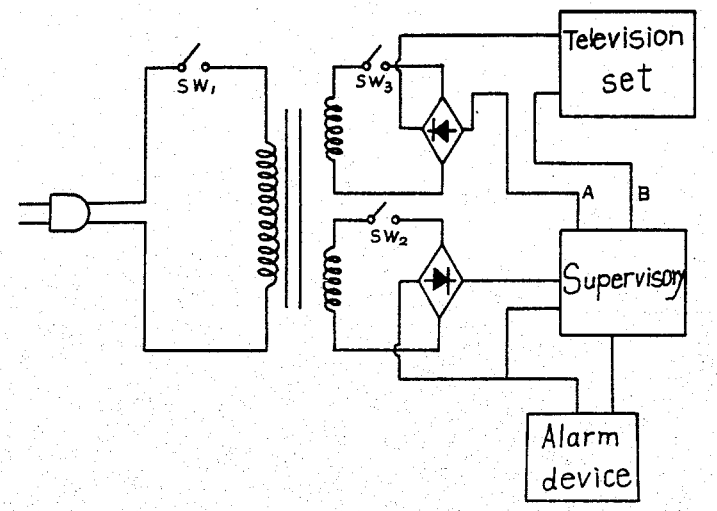
FIG. 6 shows one example of a power source supply unit for a TV set control according to the present invention.

As shown in FIG. 6, $SW_1$ is the master switch. If it is turned off, the TV set and supervisory device are inactive. $SW_2$ is the supervisory device switch and $SW_3$ is the TV set switch. When one does not need the supervisory device, the $SW_2$ can be turned off, and the two contacts A and B are inactive. If $SW_2$ and $SW_3$ are on, once somebody enters into the control distance established for the TV set, an alarm signal is given and the TV video display is blanked until that person leaves beyond the established safe watching distance; then the TV set once again resumes normal operation. To use the TV set as a burglar alarm, one turns off the TV set $SW_3$. When the burglar enters into the scope under supervision, an alarm is given. In order to adapt the device to serve as a burglar alarm a relay may be applied if necessary and a battery cell may be installed to be used in case of a power supply failure.

While putting the present invention into practice, it may be made into one integrated body or two separate bodies i.e. TV set and supervisory device—the latter controls the former by means of the switch element so as to generate the desired effect when the detecting device (1) detects the target, the signal is forwarded to the signal processing circuit (2) for proper selection, comparison and amplification so as to decide whether the switch element (4) shall be driven or not and to proceed with various alarm and established actions. After receipt of various different drive signals, the switch element (4) can enable the alarm bell device (5) to generate alarm signal, cut off or shorten the image signal for displaying only scanning lines on the fluorscent screen, or to cut off the control TV device (6), or enable the abovesaid more than two devices to perform multiple alarm actions one after another. For instance, in order to perform the supervisory function of maintaining the safe TV-watching distance, when a TV watcher is too close to the TV set and enters into the established supervisory distance, the TV set will generate the bell sound, then cut off the TV image signal and reserve the audio frequency signal so as to perform the desired function of maintaining the safe TV-watching distance.

When putting the present invention into practice, two-set distance-establishing devices can also be installed in order to change the established detecting distance by means of turning on and off the TV set. When the TV set is turned on, the detecting distance of detecting device is established at the supervisory distance of safe TV-watching; and when it is turned off, the said supervisory is changed into the established burglary detecting distance so as to achieve the purpose of alarming burglary.

We claim:

1. An apparatus comprising:

a television set, and supervisory means attached to said television set, said supervisory means including a detecting means for detecting a moving target within a predetermined distance of the front of the television set; a signal processing circuit for analyzing and amplifying a signal from said detecting means; a drive circuit, responsive to said signal processing circuit for generating a switch driving signal; first and second switch elements responsive to said drive circuit, said first switch element being adapted to actuate an alarm and said second switch element being adapted to be coupled to said television set so as to provide an indication by either or both of the audio and video thereof, of the presence of a moving target within said predetermined distance, the indication via the television set warning a viewer to move to a safe distance from the television set.

2. An apparatus comprising:

a television set;

supervisory means attached to said television set for detecting a moving target within a preselected distance of the front of said television set and producing a predetermined indication of said detection, said supervisory means including:

detection means for detecting a moving target within a predeterined distance in front of said television set;

signal processing means responsive to said dection means for analyzing and amplifying a signal from said detection means;

delay means, adapted to receive a signal from said signal processing means, for generating a delay signal after the lapse of a predetermined interval of time after receipt of said signal from said detection means to minimize false alarms that might otherwise occur when a user occasionally enters an area within said preselected distance;

drive circuit means responsive to said delay signal for producing a switch driving signal;

switch means connected to said drive circuit means for switching responsive to said switch driving signal from said drive circuit means said switch means being (a) adapted to actuate an alarm and (b) adapted to be coupled to said television set so as to provide an indication by either or both of the audio and video of a moving target within said predetermined distance; and indication means connected to said switching means for producing an indication when activated by said switching means.

3. An apparatus as claimed in claim 2 wherein said indication means comprise alarm means for producing an audible indication of said detection.

4. An apparatus as claimed in claim 2 wherein said indication means comprise video blanking means for suppressing the video display of said television set.

5. An apparatus as claimed in claim 2 wherein said indication means comprise power cut-off means for interrupting line power to said television set.

6. An apparatus as claimed in claim 2, wherein said indication means comprise:

alarm means for producing an audible indication of said detection; and video blanking means for supervising the video display of said television set.

7. An apparatus as claimed in claim 2, wherein said indication means comprise:

alarm means for producing an audible indication of said detection; and power cut-off means for interrupting line power to said television set.

8. An apparatus as claimed in claim 2, wherein said indication means comprise:

video blanking means for suppressing the video display of said television set; and power cut-off means for interrupting line power to said television set.

9. An apparatus as claimed in claim 2, wherein said indication means comprise:

alarm means for producing an audible indication of said detector;

video blanking means for suppressing the video display of said television set; and power cut-off means for interrupting line power to said television set.

10. An apparatus as claimed in claim 1 or 2 wherein said television set and said supervisory device are integrated into one chassis.

11. An apparatus as claimed in claim 1 or 2, wherein said television set and said supervisory device are housed in two separate chassis.

* * * * *